US007004827B1

(12) United States Patent
Suzuki et al.

(10) Patent No.: US 7,004,827 B1
(45) Date of Patent: Feb. 28, 2006

(54) METHOD AND APPARATUS FOR POLISHING A WORKPIECE

(75) Inventors: Shoji Suzuki, San Jose, CA (US); Koji Adachi, San Jose, CA (US); Richard Shigetoshi Mori, Sunnyvale, CA (US)

(73) Assignee: Komag, Inc., San Jose, CA (US)

( * ) Notice: Subject to any disclaimer, the term of this patent is extended or adjusted under 35 U.S.C. 154(b) by 0 days.

(21) Appl. No.: 10/777,424

(22) Filed: Feb. 12, 2004

(51) Int. Cl.
*B24B 5/00* (2006.01)

(52) U.S. Cl. ..... 451/285; 287/286; 287/398

(58) Field of Classification Search ..... 451/41, 451/285, 287, 286, 398
See application file for complete search history.

(56) References Cited

U.S. PATENT DOCUMENTS

| | | | | |
|---|---|---|---|---|
| 5,422,316 A | | 6/1995 | Desai et al. | 437/228 |
| 5,664,988 A | * | 9/1997 | Stroupe et al. | 451/41 |
| 5,795,215 A | * | 8/1998 | Guthrie et al. | 451/286 |
| 5,876,273 A | | 3/1999 | Yano et al. | 451/288 |
| 5,899,743 A | * | 5/1999 | Kai et al. | 438/690 |
| 5,914,053 A | | 6/1999 | Masumura et al. | 216/88 |
| 5,926,352 A | | 7/1999 | Murayama et al. | 360/135 |
| 6,042,688 A | | 3/2000 | Masumura et al. | 156/345 |
| 6,291,373 B1 | | 9/2001 | Sakaguchi et al. | 442/156 |
| 6,439,965 B1 | | 8/2002 | Ichino et al. | 451/36 |
| 6,454,634 B1 | | 9/2002 | James et al. | 451/41 |
| 6,454,635 B1 | | 9/2002 | Zhang et al. | 451/41 |
| 6,488,729 B1 | | 12/2002 | Ishitobi et al. | 51/307 |
| 6,500,059 B1 | | 12/2002 | Chang et al. | 451/388 |
| 6,517,422 B1 | | 2/2003 | Sakamoto et al. | 451/288 |
| 6,558,232 B1 | * | 5/2003 | Kajiwara et al. | 451/41 |
| 6,566,286 B1 | | 5/2003 | Sakaguchi et al. | 442/281 |
| 6,602,116 B1 | * | 8/2003 | Prince | 451/51 |
| 6,699,110 B1 | * | 3/2004 | Lee | 451/242 |
| 6,758,939 B1 | * | 7/2004 | Marquardt et al. | 156/345.14 |

FOREIGN PATENT DOCUMENTS

| | | |
|---|---|---|
| JP | 9-168964 | 6/1997 |
| JP | 2003-19660 | 1/2003 |

* cited by examiner

*Primary Examiner*—Eileen P. Morgan

(57) ABSTRACT

A carrier has openings for holding workpieces during polishing. Upper and lower polishing pads push against upper and lower surfaces of the workpieces, respectively. A ring is provided within the openings. This ring surrounds the workpieces, and prevents or reduces roll-off.

24 Claims, 5 Drawing Sheets

METHOD AND APPARATUS FOR POLISHING A WORKPIECE

BACKGROUND OF THE INVENTION

This invention pertains to a method and apparatus for polishing a workpiece.

A typical process for manufacturing a magnetic disk comprises the following:

1. An Al alloy substrate having an ID and an OD is provided.
2. The edges at the ID and OD of the substrate are chamfered.
3. The substrate is electroless plated with a NiP.
4. The NiP is polished. (See, for example, U.S. Pat. No. 6,149,696, issued to Jia, incorporated herein by reference.)
5. The NiP is textured. (See, for example, U.S. patent application Ser. No. 10/299,028, filed by Homola, incorporated herein by reference.)
6. One or more underlayers (e.g. Cr or a Cr alloy) are sputtered onto the textured NiP.
7. One or more magnetic layers (e.g. Co magnetic alloys) are sputtered onto the underlayers.
8. One or more protective layers (e.g. C or hydrogenated C) are deposited onto the magnetic layers. (See, for example, U.S. Pat. No. 6,565,719, issued to Lairson et al., incorporated herein by reference.)

(Other layers, e.g. Ru intermediate layers, seed layers, and other types of layers are sometimes deposited at different points during the manufacturing process. See, for example, U.S. patent application Ser. No. 10/075,123, filed by Bertero et al., incorporated herein by reference.)

As described by Jia, substrates are often polished in planetary polishing apparatus. FIGS. 1A and 1B schematically illustrate in plan view and cross section, respectively, polishing apparatus 1 constructed in accordance with the prior art. Such apparatus comprises a substrate holder 2 having openings 3 for accommodating substrates 4 that are to be polished. (Substrates 4 have a centrally defined opening 4*c* therein.) Holder 2 is roughly circular, and comprises teeth 5 for engaging with a central "sun gear" 6 and for engaging with an outer gear 7. Gears 6 and 7 cause holder 2 to revolve around sun gear 6 (see arrow A) while simultaneously rotating about the center 8 of holder 2 (see arrow B). Upper and lower pads 9, 10 (mounted on rigid platens 11, 12 respectively) press against the upper and lower surfaces 4*a*, 4*b* of substrates 4. Slurry is provided between pads 9, 10 and substrates 4 to polish substrates 4.

At the conclusion of polishing, it would be desirable for the substrate 4 to have a profile as shown in cross section in FIG. 2. Unfortunately, substrates often emerge from the polishing process with a defect called "roll-off", schematically shown by dotted lines R in FIG. 3, which extends into the data zone 4*z*. (Data zone 4*z* is where data will ultimately be recorded on the disk when it is finished.) One cause of roll-off is that substrates 4 have a thickness T4 that is greater than thickness T2 of carrier 2. Therefore, pads 9, 10 tend to push harder against the edges E of substrates 4, thereby causing roll-off. It would be desirable to prevent roll-off.

SUMMARY

Apparatus in accordance with the invention comprises a carrier for holding a workpiece being polished. The workpiece is typically disk-shaped or circular. A ring is provided between the carrier and the workpiece. During use, the workpiece is held within the carrier, and one or both sides of the workpiece move against a polishing pad to polish the workpiece. In one embodiment, planetary polishing apparatus is used during polishing, and slurry is introduced between the polishing pad and the workpiece. (In such an embodiment, first and second polishing pads are urged against first and second sides of the workpiece, respectively, during polishing.) The ring is substantially as thick as or thicker than the workpiece, and prevents "roll-off" in the workpiece at the outer edge of the workpiece.

In one embodiment, the ring is not rigidly affixed to the carrier, and therefore can rotate during use. Also, in one embodiment, the ring has a gap in it. As explained below, in one embodiment this gap a) makes it easier to meet manufacturing tolerances when making the ring so that it fits into the carrier; and b) facilitates rotation of the ring and workpiece within the carrier during use for more even and uniform polishing. The ring can be manufactured by cutting sections of a spring.

A method in accordance with the invention comprises placing a workpiece and a ring within a carrier, and causing at least one polishing pad to move with respect to the workpiece to thereby polish at least one surface of the workpiece. As mentioned above, planetary polishing apparatus can be used during this method. The ring can rotate within the carrier, and the workpiece can rotate within the ring during polishing. The ring contains a gap. In one embodiment, this gap a) makes it easier to meet manufacturing tolerances when making the ring so that it fits into the carrier; and b) facilitates rotation of the ring and workpiece within the carrier during use.

The figures are not drawn to scale.

DETAILED DESCRIPTION

Figure 1A:
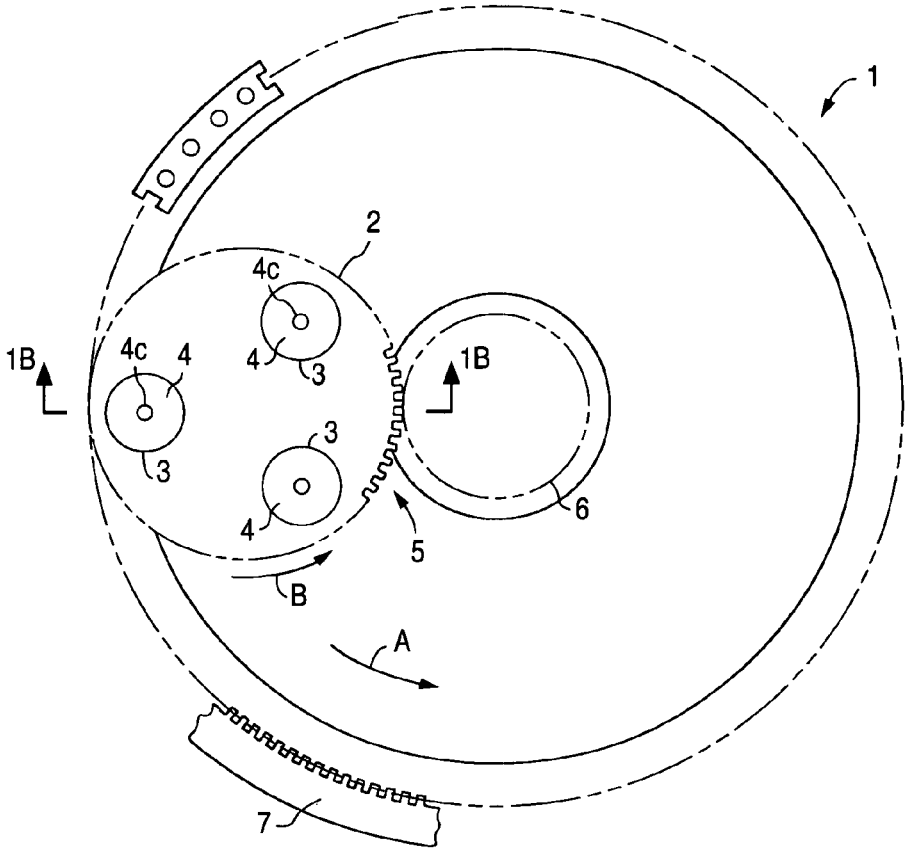
FIG. 1A (PRIOR ART)
FIGS. 1A and 1B illustrate in plan view and cross section, respectively, planetary polishing apparatus constructed in accordance with the prior art.
Figure 1B:
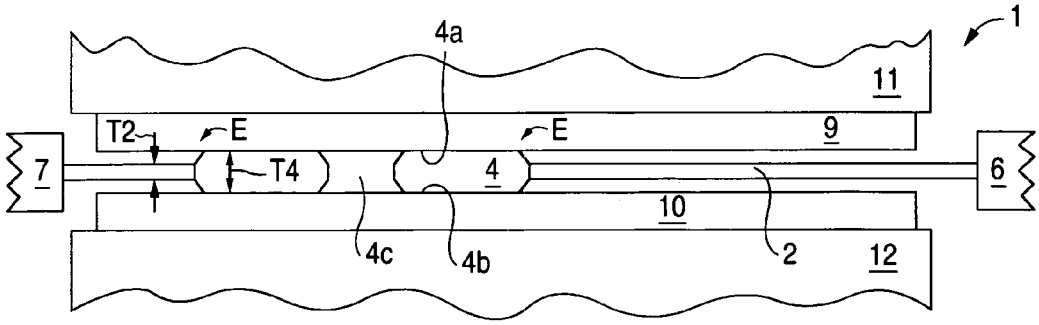
FIG. 1B (PRIOR ART)
Figure 2:
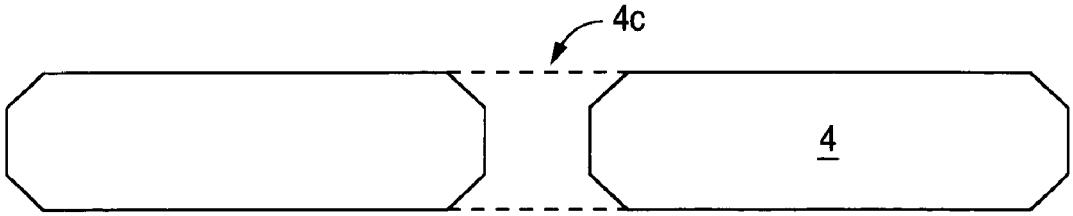
FIG. 2 illustrates in cross section a desired profile of a substrate
Figure 3:
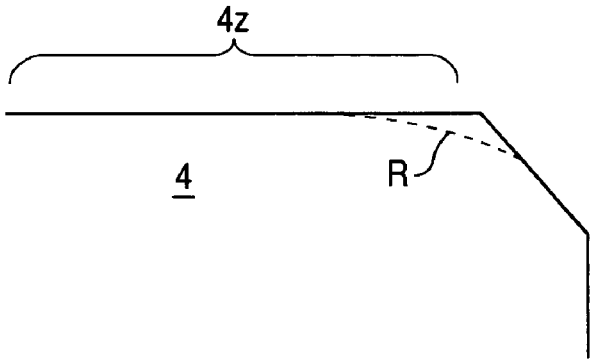
FIG. 3 (PRIOR ART)
FIG. 3 illustrates in cross section a substrate having "roll-off".
Figure 4A:
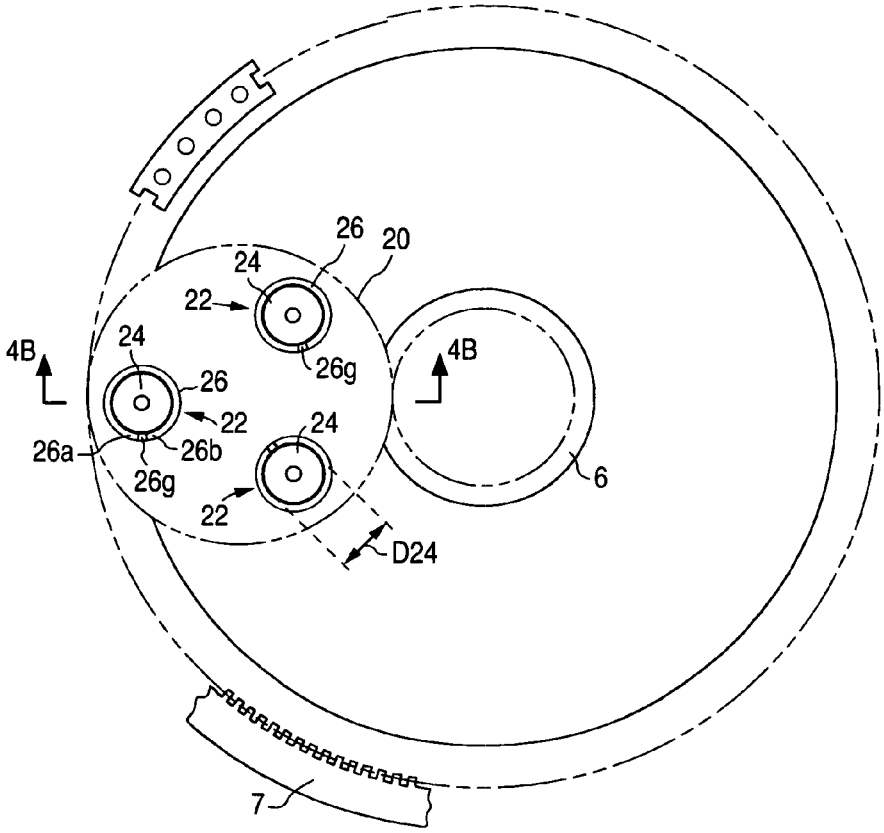
FIGS. 4A and 4B illustrate in plan view and cross section, respectively, polishing apparatus constructed in accordance with a first embodiment of the present invention.
Figure 4B:
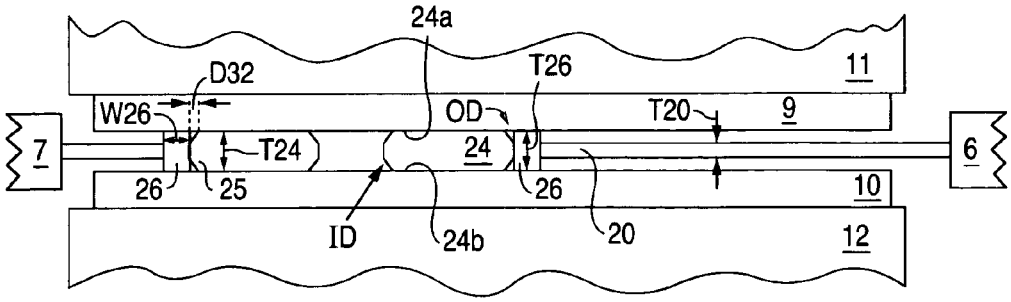

Referring to FIGS. 4A and 4B, a holder 20 comprises openings 22 for holding disk-shaped workpieces 24. In one embodiment, workpieces 24 are substrates used for manufacturing magnetic disks, and can comprise an Al alloy electroless plated with a NiP alloy. However, workpieces 24 can be other types of workpieces as well. Holder 20 can be used in conjunction with planetary polishing apparatus such as model no. 9B14, manufactured by Speedfam International Corp. of Des Plaines, Ill. However, other types of polishing apparatus can also be used, e.g. single disk polishers and ring polishers.

Polishing pads 9, 10 push against upper and lower surfaces 24*a*, 24*b*, respectively, of workpieces 24. Pads 9, 10 can be device model no. CR200, manufactured by Kanebo, or device model no. FK1, manufactured by Fujibo (located in Japan). However, other types of pads can also be used. Pads 9, 10 are affixed to rigid platens 11, 12, respectively, which urge pads 9, 10 against workpieces 24. One or more openings (not shown) can be provided in platens 11, 12 and/or pads 9, 10 to permit introduction of slurry between the pads and workpieces during polishing.

In one embodiment, workpieces 24 have a diameter D24 of 95 mm and a thickness T24 of 1.27 mm. However, these dimensions are merely exemplary. Holder 20 can be fiberglass or an aramid material. Holder 20 is preferably thinner than workpieces 24 (e.g. having a thickness T20 between 0.8 and 1.2 mm, and preferably 1.0 mm) to avoid pushing against and scraping slurry off of polishing pads 9, 10. The material and dimensions of holder 20 are merely exemplary.

Within openings 22 are rings 26 which surround workpieces 24. Rings 26 are generally not rigidly affixed to holder 20, and thus it is typically possible for rings 26 to rotate within openings 22. (It is also typically possible for workpieces 24 to rotate within rings 26.) Rings 26 have a thickness T26 (FIG. 4B) that is greater than thickness T24, and typically greater than T26 plus 2 $\mu$m. In one embodiment, T26 minus T24 is between about 2 and 100 $\mu$m, e.g. 20 $\mu$m. These numbers are exemplary, but it is generally desirable that T26 be greater than T24 to minimize or avoid roll-off. Also, in one embodiment, rings 26 have a width W26 of about 1.5 mm, but this is also exemplary. FIG. 4A also shows an optional chamfer 25 at the OD of workpiece 24. Chamfer 25 is preferably a 45° chamfer, although other angles (e.g. 30°) can be used. (Optionally, chamfers can also be present at the ID of workpieces 24.) The flat upper and lower surfaces of workpiece 24 are typically a distance D32 of 0.122 mm from ring 26.

In one embodiment, the hardness of the material from which rings 26 is manufactured is greater than or equal to the hardness of workpiece 24. As mentioned above, in one embodiment, workpiece 24 comprises a NiP-coated substrate. In such an embodiment, rings 26 can also be made from NiP (or a material coated with NiP).

Rings 26 have gaps 26*g* therein. In one embodiment, the gaps have a width between 0 and 5 mm (preferably closer to 0 mm than 5 mm). Gaps 26*g* provide the following advantages.

1. It is easier to manufacture rings 26 because it is unnecessary for rings 26 to have an outer diameter exactly equal to the inner diameter of openings 22. If the diameter of a ring 26 is too great to fit into an opening 22, one can pull ends 26*a*, 26*b* of ring 26 (FIG. 4A) closer together so that ring 26 fits into opening 22. Similarly, if the diameter of ring 26 is too small to permit insertion of workpiece 24, ends 26*a*, 26*b* can be pulled apart so that ring 26 can accommodate placement of workpiece 24 therein.

2. Because of gap 26*g*, it is easier to ensure that ring 26 can rotate within opening 22 (relative to carrier 20) and that workpiece 24 can rotate within ring 26. This has the advantage of permitting more even and uniform polishing.

From the foregoing it is seen that there is a discontinuity in ring 26 between ends 26*a* and 26*b*. As used herein, the term "discontinuity" encompasses a gap such as gap 26*g*. The term "discontinuity" also encompasses a situation in which end 26*a* is flush against end 26*b*, as may happen from time to time because of manufacturing tolerances during the manufacture of workpiece 24, ring 26 and/or holder 20.

Figure 5A:
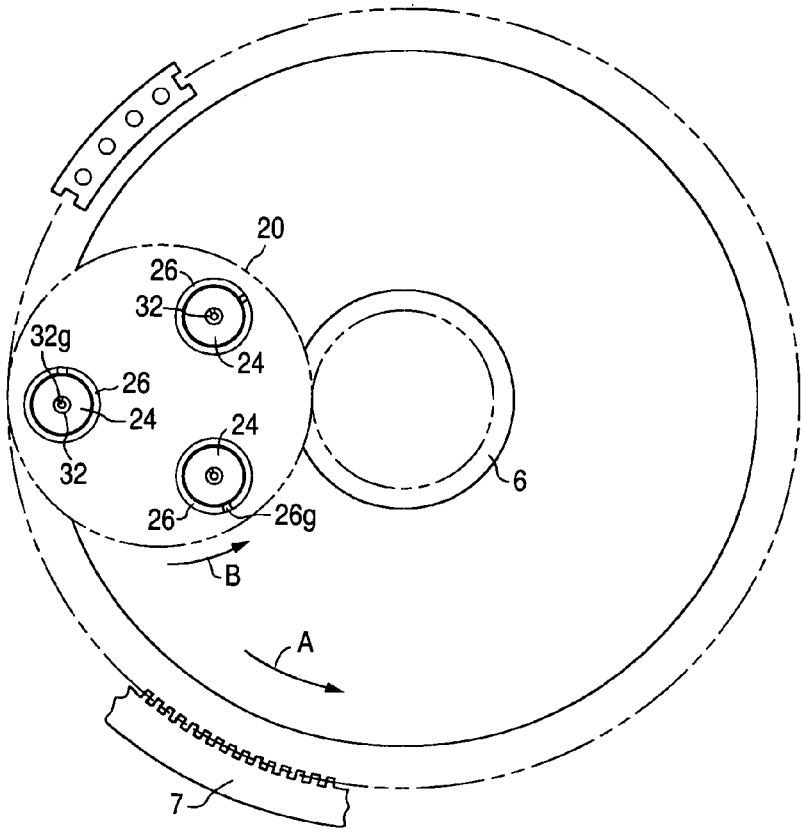
FIGS. 5A and 5B illustrate in plan view and cross section, respectively, polishing apparatus constructed in accordance with a second embodiment of the present invention.
Figure 5B:
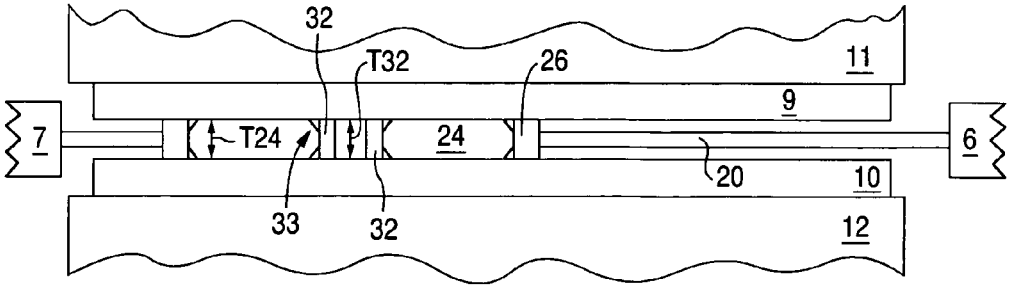

Referring to FIGS. 5A and 5B, in a second embodiment of the invention, a ring 32 is inserted into the ID of workpiece 24 to prevent roll-off at the ID. (Workpiece 24 shown in FIG. 5B comprises a chamfer 33 at its ID.) Ring 32 is made from a material similar to or the same as that used to manufacture ring 26. In other words, ring 32 is typically as hard as or harder than the material used to make workpiece 24. Ring 32 preferably has a gap 32*g* therein (although in other embodiments, gap 32*g* is not provided in ring 32). Also, ring 32 has a thickness similar to or the same as that of ring 26. Thus, the thickness T32 of ring 32 is typically about as great as or greater than the thickness T24 of workpiece 24. (It should be noted that the invention can be practiced using ring 32 without ring 26 present, or using ring 26 without ring 32 present, e.g. if one is only concerned with preventing roll-off at just the ID or just the OD.)

Figure 6A:
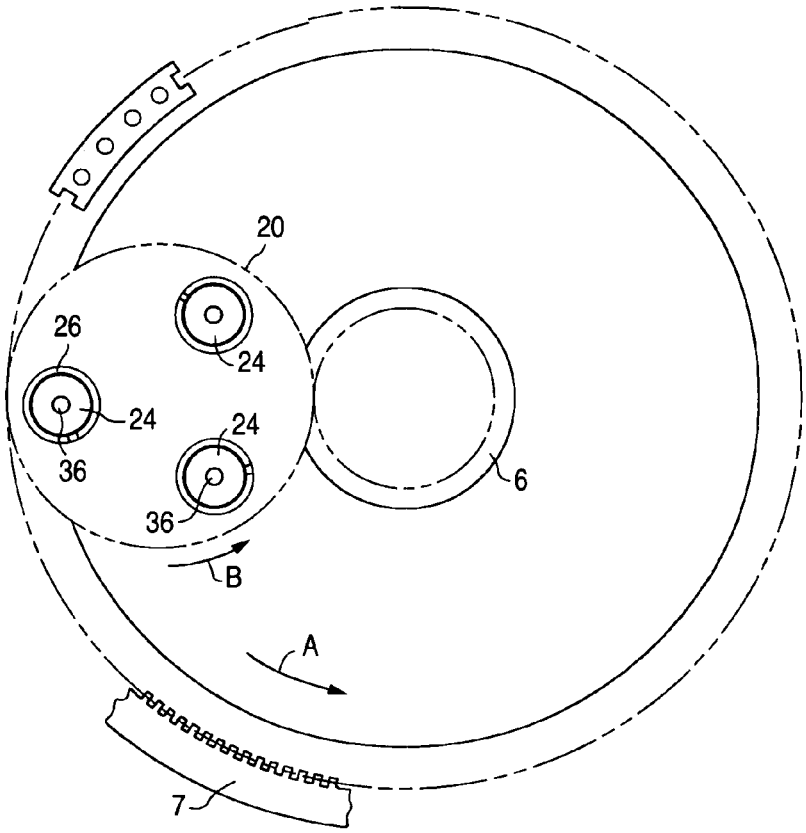
FIGS. 6A and 6B illustrate in plan view and cross section, respectively, polishing apparatus constructed in accordance with a third embodiment of the present invention.
Figure 6B:
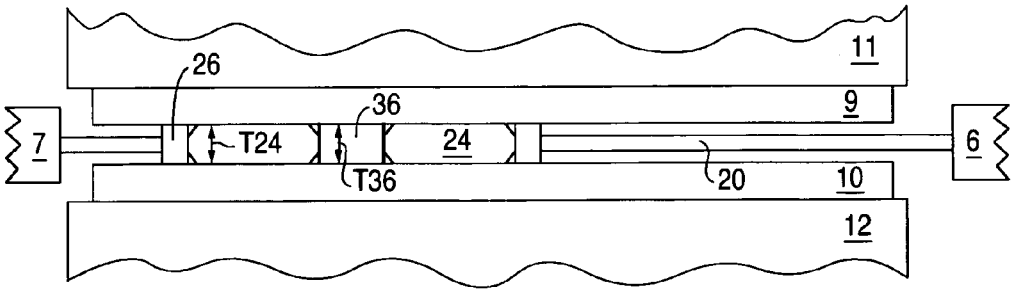

Referring to FIGS. 6A and 6B, in a third embodiment of the invention, a disk 36 is inserted into the central opening of workpiece 24. Disk 36 is made of a material similar to or the same as that used to manufacture ring 26. In other words, the hardness of disk 36 is typically equal to or greater than that of workpiece 24. Preferably has a thickness similar to or the same as that of ring 26. Thus, thickness T36 of disk 36 is typically approximately equal to or greater than thickness T24 of workpiece 24. In this embodiment, disk 36 prevents roll-off at the ID of workpiece 24. (It should be noted that the invention can be practiced using disk 36 without ring 26 present, or using ring 26 without disk 36 present, e.g. if one is only concerned with preventing roll-off at just the ID or just the OD.)

As mentioned above, typical magnetic disk substrates comprise an Al alloy plated with a NiP alloy. However, the present invention can be used in conjunction with other types of layers deposited on a substrate, e.g. a soft magnetic layer of the type used to manufacture perpendicular recording magnetic disks. In addition, the invention can be used in conjunction with the polishing of other types of substrates, e.g. glass, glass ceramic, ceramic, carbon, and metals such as Ti or Ti alloys. It is desirable to polish such materials, and prevent roll-off therein. Such substrates can be used to manufacture magnetic disks. In addition, the present invention can be used in conjunction with the polishing of semiconductor wafers during integrated circuit manufacturing (e.g. silicon, gallium arsenide or other semiconductor materials).

While the invention has been described with respect to specific embodiments, those skilled in the art will recognize that changes can be made in form and detail without departing from the spirit and scope of the invention. For example, different types of workpieces can be used in conjunction with the invention. Different types of polishing apparatus can be used (e.g. planetary polishers, ring polishers, single disk polishers, polishers that polish only one side of a workpiece at a time or polishers that polish both sides of a workpiece at a time). A holder used in conjunction with the invention can have one or more openings. Accordingly, all such changes come within the invention.

We claim:

1. Structure comprising:

a generally planar workpiece carrier comprising at least one opening for holding a generally disk-shaped workpiece; and a ring movably placed within said at least one opening, said ring having a top surface, a bottom surface, and a discontinuity extending from said top surface through said bottom surface for adjusting the diameter of said ring.

2. Structure of claim 1 wherein said ring is rotatable within said opening.

3. Structure of claim 1 further comprising a workpiece within said opening and surrounded by said ring, wherein said workpiece can rotate with respect to said carrier.

4. Structure of claim 3 wherein said carrier is within polishing apparatus, said polishing apparatus comprising one or more pads for polishing said workpiece, said ring having a thickness such that said ring prevents or reduces roll-off in said workpiece.

5. Structure of claim 1 wherein said workpiece comprises a centrally defined opening therein, said structure further comprising a member inserted into said centrally defined opening.

6. Structure of claim 1 wherein said workpiece is rotatable with respect to said ring.

7. A combination of a workpiece and apparatus, wherein said workpiece has an opening therein and said apparatus comprises:

a generally planar workpiece carrier comprising at least one opening for holding said workpiece;

a member inserted into said opening of said workpiece; and at least one polishing pad for polishing at least one surface of said workpiece, said polishing pad extending over said workpiece, said opening of said workpiece and said member, and wherein said member prevents or reduces roll-off in said workpiece near the opening of said workpiece when said workpiece is being polished by said polishing pad.

8. Combination of claim 7 wherein said member comprises either a disk or a first ring, said combination further comprising a second ring within the opening of said carrier and surrounding said workpiece.

9. A combination of a workpiece and apparatus, wherein said workpiece has an opening therein and said apparatus comprises:

a generally planar workpiece carrier comprising at least one opening for holding said workpiece;

a member inserted into said opening of said workpiece; and at least one polishing pad for polishing at least one surface of said workpiece, said pad extending over said opening of said workpiece, said workpiece and said member, wherein said member prevents or reduces roll-off near the opening of said workpiece.

10. Method comprising:

providing a structure comprising a generally planar workpiece carrier comprising at least one opening:

providing a ring within said at least one opening, said ring having a top surface, a bottom surface and a discontinuity extending from said top surface through said bottom surface for adjusting the diameter of said ring;

placing a generally disk-shaped workpiece within said ring, said workpiece being rotatable within said opening; and polishing said workpiece by applying at least one polishing pad surface against said workpiece.

11. Method of claim 10 wherein said workpiece can rotate during polishing.

12. Method of claim 10 wherein said ring prevents or reduces roll-off in said workpiece during polishing.

13. Method of claim 10 wherein said polishing comprises applying two generally planar polishing pads against upper and lower surfaces of said workpiece, and applying a polishing slurry between said pads and said workpiece during polishing.

14. Method of claim 10 wherein said workpiece comprises a centrally defined opening therein, said structure further comprising a member inserted into said centrally defined opening.

15. Method of claim 10 wherein said workpiece is rotatable with respect to said ring.

16. Method comprising:

providing a structure comprising a generally planar workpiece carrier comprising at least one opening;

placing a generally disk-shaped workpiece within said opening of said carrier, said workpiece having an opening therein;

providing a member within said opening of said workpiece; and polishing said workpiece by applying at least one polishing pad against said workpiece, wherein said workpiece carrier, member and polishing pad act as at least a portion of polishing apparatus, said polishing pad extending over said workpiece, said opening of said workpiece and said member during at least part of said act of polishing, and wherein said member prevents or reduces roll-off in said workpiece near the opening of said workpiece when said workpiece is being polished by said polishing pad.

17. Method of claim 16 wherein said member comprises either a first ring or a disk within the opening of said workpiece, said method further comprising providing a second ring between said workpiece and said carrier, said second ring preventing or reducing roll-off in said workpiece during polishing.

18. Method comprising:

providing a structure comprising a generally planar workpiece carrier comprising at least one opening;

placing a generally disk-shaped workpiece within said opening of said carrier, said workpiece having an opening therein;

providing a member within said opening of said workpiece; and polishing said workpiece by applying at least one polishing pad against said workpiece, wherein said workpiece carrier, member and polishing pad act as at least a portion of polishing apparatus, wherein said member prevents or reduces roll-off of said workpiece near said opening of said workpiece, said pad extending over said opening of said workpiece, said workpiece and said member.

19. Structure comprising:

a generally planar workpiece carrier comprising at least one opening for holding a generally disk-shaped workpiece; and a ring movably placed within said at least one opening, said ring having a break therein, wherein the material of said ring on one side of said break is not rigidly affixed to the material of said ring on the other side of said break, wherein said workpiece is rotatable with respect to said opening.

20. Structure of claim 19 wherein said break comprises a gap in said ring.

21. Structure of claim 19 wherein material of said ring on one side of said break contacts the material of said ring on the other side of said break.

22. Method comprising:

providing a structure comprising a generally planar workpiece carrier comprising at least one opening:

providing a ring within said at least one opening, said ring having a break therein;

placing a generally disk-shaped workpiece within said ring; and polishing said workpiece by applying at least one polishing pad surface against said workpiece, wherein material of said ring on one side of said break is not rigidly affixed to the material of said ring on the other side of said break, wherein said workpiece is rotatable with respect to said opening.

23. Method of claim 22 wherein said break comprises a gap in said ring.

24. Method of claim 22 wherein the material of said ring on one side of said break contacts the material of said ring on the other side of said break.

* * * * *